US011655526B2

(12) United States Patent
Eguchi et al.

(10) Patent No.: US 11,655,526 B2
(45) **Date of Patent: *May 23, 2023**

(54) DUPLEX STAINLESS STEEL AND METHOD FOR PRODUCING SAME

(71) Applicant: JFE STEEL CORPORATION, Tokyo (JP)

(72) Inventors: Kenichiro Eguchi, Tokyo (JP); Masao Yuga, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 90 days.

This patent is subject to a terminal disclaimer.

(21) Appl. No.: 16/476,970

(22) PCT Filed: Dec. 20, 2017

(86) PCT No.: PCT/JP2017/045748

§ 371 (c)(1),
(2) Date: Jul. 10, 2019

(87) PCT Pub. No.: WO2018/131412

PCT Pub. Date: Jul. 19, 2018

(65) Prior Publication Data

US 2019/0352752 A1 Nov. 21, 2019

(30) Foreign Application Priority Data

Jan. 10, 2017 (JP) ..... JP2017-001683

(51) Int. Cl.

| | |
|---|---|
| ***C22C 38/42*** | (2006.01) |
| ***C21D 6/00*** | (2006.01) |
| ***C21D 8/10*** | (2006.01) |
| ***C21D 9/08*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/48*** | (2006.01) |
| ***C22C 38/50*** | (2006.01) |

(52) U.S. Cl.

CPC ..... *C22C 38/42* (2013.01); *C21D 6/004* (2013.01); *C21D 6/008* (2013.01); *C21D 8/105* (2013.01); *C21D 9/085* (2013.01); *C22C 38/02* (2013.01); *C22C 38/04* (2013.01); *C22C 38/06* (2013.01); *C22C 38/44* (2013.01); *C22C 38/48* (2013.01); *C22C 38/50* (2013.01); *C21D 2211/001* (2013.01); *C21D 2211/005* (2013.01)

(58) Field of Classification Search

CPC ..... C21D 2211/001; C21D 2211/005
See application file for complete search history.

(56) References Cited

U.S. PATENT DOCUMENTS

| | | | | | |
|---|---|---|---|---|---|
| 3,574,002 | A * | 4/1971 | Hayden | C22C 38/40 148/325 | |
| 4,055,448 | A * | 10/1977 | Fujikura | C22C 38/44 148/325 | |
| 4,816,085 | A * | 3/1989 | Flasche | B23K 35/3086 148/327 | |
| 6,689,231 | B1 | 2/2004 | Kangas | | |

FOREIGN PATENT DOCUMENTS

| | | | | |
|---|---|---|---|---|
| EP | 3 112 492 | A1 | 1/2017 | |
| GB | 1 158 614 | A | 7/1969 | |
| JP | S50-105504 | A | 8/1975 | |
| JP | S61-23713 | A | 2/1986 | |
| JP | S61-157626 | A | 7/1986 | |
| JP | 05-302151 | A | 11/1993 | |
| JP | H05-302150 | A | 11/1993 | |
| JP | H07-207337 | A | 8/1995 | |
| JP | H10-60526 | A | 3/1998 | |
| JP | 2004-315870 | A | 11/2004 | |
| JP | 2009-46759 | A | 3/2009 | |
| JP | 2016089223 | A * | 5/2016 | C22C 38/58 |
| JP | 2016-117944 | A | 6/2016 | |
| JP | 2016117944 | A * | 6/2016 | |
| JP | 2016-216816 | A | 12/2016 | |
| WO | WO-2016072244 | A1 * | 5/2016 | C22C 38/06 |
| WO | 2016/162525 | A1 | 10/2016 | |

OTHER PUBLICATIONS

Jan. 15, 2021 Office Action issued in Chinese Patent Application No. 201780082846.6.
Oct. 11, 2019 Extended Search Report issued in European Patent Application No. 17891664.9.
Jul. 22, 2020 Office Action issued in Chinese Patent Application No. 2017800828466.
Feb. 11, 2021 Office Action issued in U.S. Appl. No. 16/325,572.
Apr. 3, 2018 International Search Report issued in International Patent Application No. PCT/JP2017/045748.
Jul. 26, 2021 Office Action issued in U.S. Appl. No. 16/325,572.
Feb. 4, 2022 Office Action issued in U.S. Appl. No. 16/325,572.
May 10, 2022 Office Action issued in U.S. Appl. No. 16/325,572.

* cited by examiner

*Primary Examiner* — Anthony J Zimmer
*Assistant Examiner* — Jacob J Gusewelle
(74) *Attorney, Agent, or Firm* — Oliff PLC

(57) ABSTRACT

A duplex stainless steel having excellent carbon dioxide corrosion resistance, excellent sulfide stress corrosion cracking resistance, and excellent sulfide stress cracking resistance. The duplex stainless steel comprises, by mass %, C: 0.03% or less, Si: 1.0% or less, Mn: 0.10 to 1.5%, P: 0.030% or less, S: 0.005% or less, Cr: 20.0 to 30.0%, Ni: 5.0 to 10.0%, Mo: 2.0 to 5.0%, Cu: 2.0 to 6.0%, N: less than 0.07%, at least one selected from Al: 0.05 to 1.0%, Ti: 0.02 to 1.0%, and Nb: 0.02 to 1.0%, and the balance being Fe and unavoidable impurities, and has a structure that is 20 to 70% austenite phase, and 30 to 80% ferrite phase in terms of a volume fraction.

6 Claims, No Drawings

DUPLEX STAINLESS STEEL AND METHOD FOR PRODUCING SAME

TECHNICAL FIELD

This application relates to a duplex stainless steel preferred for use in oil well and gas well applications (hereinafter, also referred to as "oil country tubular goods") such as in crude oil wells and natural gas wells, and to a method for producing such a duplex stainless steel. A duplex stainless steel of the disclosed embodiments can be used as a stainless steel seamless pipe having high strength and excellent corrosion resistance, particularly carbon dioxide corrosion resistance in a severe high-temperature corrosive environment containing carbon dioxide gas ($CO_2$) and chlorine ions ($Cl^-$), and high-temperature sulfide stress corrosion cracking resistance (SCC resistance) and ordinary-temperature sulfide stress cracking resistance (SSC resistance) in an environment containing hydrogen sulfide ($H_2S$), and preferred for use as oil country tubular goods.

BACKGROUND

Increasing crude oil prices, and the increasing shortage of petroleum resources have prompted active development of deep oil fields that were unthinkable in the past, and oil fields and gas fields of a severe corrosive environment, or a sour environment as it is also called, where hydrogen sulfide and other corrosive gases are present. Such oil fields and gas fields are typically very deep, and involve a severe, high-temperature corrosive environment of an atmosphere containing $CO_2$, $Cl^-$, and $H_2S$. Steel pipe materials for oil country tubular goods intended for such an environment require high strength, and excellent corrosion resistance (carbon dioxide corrosion resistance, sulfide stress corrosion cracking resistance, and sulfide stress cracking resistance).

Oil country tubular goods used for mining of oil fields and gas fields of an environment containing $CO_2$ gas, $Cl^-$, and the like typically use duplex stainless steel pipes.

For example, PTL 1 discloses a duplex stainless steel of a composition containing, in mass %, C≤0.03%, Si≤1.0%, Mn≤1.5%, P≤0.03%, S≤0.0015%, Cr: 24.0 to 26.0%, Ni: 9.0 to 13.0%, Mo: 4.0 to 5.0%, N: 0.03 to 0.20%, Al: 0.01 to 0.04%, O≤0.005%, and Ca: 0.001 to 0.005%. In the composition, the amounts of S, O, and Ca are restricted, and Cr, Ni, Mo, and N, which greatly contribute to the phase balance that affects hot workability, are contained in restricted amounts. In this way, the duplex stainless steel of this related art can maintain the same level of hot workability seen in traditional steels, and the corrosion resistance against $H_2S$ can improve with the optimized restricted amounts of Cr, Ni, Mo, and N added to the stainless steel.

However, the technique described in PTL 1 can only achieve a yield strength as high as about 80 ksi, and is applicable to only limited steel pipes for oil country tubular goods applications.

This problem has been addressed, and high-strength duplex stainless steels are proposed that are preferred for oil country tubular goods.

For example, PTL 2 discloses a method for producing a duplex stainless steel pipe having the levels of corrosion resistance and strength required for oil country tubular goods applications. In this method, a duplex stainless steel material containing, in mass %, C: 0.03% or less, Si: 1% or less, Mn: 0.1 to 2%, Cr: 20 to 35%, Ni: 3 to 10%, Mo: 0 to 4%, W: 0 to 6%, Cu: 0 to 3%, N: 0.15 to 0.35%, and the balance Fe and impurities is subjected to hot working, and, optionally, a solid-solution heat treatment to make a pipe material for cold working, and a steel pipe is produced upon cold drawing, which is carried out under the conditions in which the degree of working Rd in terms of a percentage reduction of a cross section in the final cold drawing ranges from 5 to 35%, and satisfies the formula (Rd (%)≥(MYS-55)/17.2-{1.2×Cr+3.0×(Mo+0.5×W)}).

PTL 3 discloses a method for producing a high-strength duplex stainless steel having improved corrosion resistance. In this method, a Cu-containing duplex stainless steel is hot worked by being heated to 1,000° C. or more, and quenched directly from a temperature of 800° C. or more, and subjected to an aging process.

PTL 4 discloses a method for producing a seawater-resistant, precipitation strengthened duplex stainless steel. In this method, a seawater-resistant, precipitation strengthened duplex stainless steel containing, in weight %, C: 0.03% or less, Si: 1% or less, Mn: 1.5% or less, P: 0.04% or less, S: 0.01% or less, Cr: 20 to 26%, Ni: 3 to 7%, Sol. Al: 0.03% or less, N: 0.25% or less, Cu: 1 to 4%, at least one of Mo: 2 to 6% and W: 4 to 10%, Ca: 0 to 0.005%, Mg: 0 to 0.05%, B: 0 to 0.03%, Zr: 0 to 0.3%, and a total of 0 to 0.03% of Y, La, and Ce, and in which the seawater resistance index PT satisfies PT≥35, and the G value representing an austenite fraction satisfies 70≥G≥30 is subjected to a solution treatment at 1,000° C. or more, and to an aging heat treatment between 450 to 600° C.

PTL 5 discloses a method for producing a high-strength duplex stainless steel material that can be used as an oil well logging line or the like for deep oil wells and gas wells. In this method, a solution-treated Cu-containing austenite-ferrite duplex stainless steel material is subjected to cold working at a cross section percentage reduction of 35% or more. After being heated to a temperature range of 800 to 1,150° C. at a heating rate of 50° C./sec or more, the stainless steel material is quenched, and cold worked again after warm working at 300 to 700° C. The cold working is followed by an optional aging process at 450 to 700° C.

PTL 6 discloses a method for producing a duplex stainless steel for sour-gas oil country tubular goods. In this method, a steel containing C: 0.02 wt % or less, Si: 1.0 wt % or less, Mn: 1.5 wt % or less, Cr: 21 to 28 wt %, Ni: 3 to 8 wt %, Mo: 1 to 4 wt %, N: 0.1 to 0.3 wt %, Cu: 2 wt % or less, W: 2 wt % or less, Al: 0.02 wt % or less, Ti, V, Nb, and Ta: 0.1 wt % or less each, Zr and B: 0.01 wt % or less each, P: 0.02 wt % or less, and S: 0.005 wt % or less is subjected to a solution heat treatment at 1,000 to 1,150° C., followed by an aging heat treatment at 450 to 500° C. for 30 to 120 minutes.

CITATION LIST

Patent Literature

PTL 1: JP-A-H5-302150
PTL 2: JP-A-2009-46759
PTL 3: JP-A-S61-23713
PTL 4: JP-A-H10-60526
PTL 5: JP-A-H7-207337
PTL 6: JP-A-S61-157626

SUMMARY

Technical Problem

Recent development of oil fields and gas fields in severe corrosive environments has created a demand for a steel pipe for oil country tubular goods that has high strength and corrosion resistance. As used herein, "corrosion resistance" means having excellent carbon dioxide corrosion resistance at a high temperature of 200° C. or more, excellent sulfide stress corrosion cracking resistance (SCC resistance) at a low temperature of 80° C. or less, and excellent sulfide stress cracking resistance (SSC resistance) at an ordinary temperature of 20 to 30° C. in a $CO_2$—, $Cl^-$—, and $H_2S$-containing severe corrosive environment. There is also a demand for improving economy (cost and efficiency).

The technique described in PTL 2 is not satisfactory, though corrosion resistance and strength are improved. The method that involves cold drawing is also expensive. Another problem is low efficiency, requiring a long production time. The technique described in PTL 3 achieves strength with a yield strength of about 78.9 kgf/mm$^2$ without cold drawing. However, the technique is insufficient in terms of sulfide stress corrosion cracking resistance and sulfide stress cracking resistance at a low temperature of 80° C. or less. The techniques described in PTL 4 to PTL 6 achieve high strength with a yield strength of 758 MPa or more without cold drawing. However, these techniques are also insufficient in terms of sulfide stress corrosion cracking resistance and sulfide stress cracking resistance at a low temperature of 80° C. or less.

In light of these problems, it is an object of the disclosed embodiments to provide a duplex stainless steel having high strength and excellent corrosion resistance (excellent carbon dioxide corrosion resistance, excellent sulfide stress corrosion cracking resistance, and excellent sulfide stress cracking resistance also in a severe corrosive environment such as above), preferred for use in oil country tubular goods used in oil well and gas well applications such as in crude oil wells and natural gas wells. The disclosed embodiments are also intended to provide a method for producing such a duplex stainless steel.

As used herein, "high-strength" means a yield strength of 110 ksi or more as measured according to the API-5CT specifications, specifically, a yield strength of 758 MPa or more.

As used herein, "excellent carbon dioxide corrosion resistance" means that a test piece dipped in a test solution (a 20 mass % NaCl aqueous solution; liquid temperature: 200° C.; 30 atm $CO_2$ gas atmosphere) charged into an autoclave has a corrosion rate of 0.125 mm/y or less after 336 hours in the solution. As used herein, "excellent sulfide stress corrosion cracking resistance" means that a test piece dipped in an aqueous test solution (a 10 mass % NaCl aqueous solution; liquid temperature: 80° C.; a 2 MPa $CO_2$ gas, and 35 kPa $H_2S$ atmosphere) in an autoclave does not crack even after 720 hours under an applied stress equal to 100% of the yield stress. As used herein, "excellent sulfide stress cracking resistance" means that a test piece dipped in an aqueous test solution (a 20 mass % NaCl aqueous solution; liquid temperature: 25° C.; a 0.07 MPa $CO_2$ gas, and 0.03 MPa $H_2S$ atmosphere) having an adjusted pH of 3.5 with addition of acetic acid and sodium acetate in a test cell does not crack even after 720 hours under an applied stress equal to 90% of the yield stress.

Solution to Problem

In order to achieve the foregoing objects, the present inventors conducted intensive studies of a duplex stainless steel with regard to factors that affect strength, carbon dioxide corrosion resistance, sulfide stress corrosion cracking resistance, and sulfide stress cracking resistance. The investigations led to the following findings.

The steel studied had a composite structure that was 20 to 70% austenite phase, and contained a ferrite phase as a secondary phase. With such a steel structure, a duplex stainless steel can be provided that has excellent carbon dioxide corrosion resistance, and excellent high-temperature sulfide stress corrosion cracking resistance in a $CO_2$—, $Cl^-$—, and $H_2S$-containing high-temperature corrosive environment where the temperature reaches 200° C. or higher, and in a $CO_2$—, $Cl^-$—, and $H_2S$-containing corrosive atmosphere where a stress nearly the same as the yield strength is applied. It was also found that high strength with a YS of 110 ksi (758 MPa) or more can be achieved without cold working when a structure containing more than a certain quantity of copper, and more than a certain quantity of at least one of Al, Ti, and Nb is subjected to an aging heat treatment. Knowing that the main cause of sulfide stress corrosion cracking, and sulfide stress cracking is the active dissolution in a temperature range of more than 80° C., it was found that (1) hydrogen embrittlement is the main cause of sulfide stress corrosion cracking and sulfide stress cracking in a temperature range of 80° C. or less, and (2) nitrides serve as hydrogen trapping sites, and increase hydrogen absorption, and reduce the resistance against hydrogen embrittlement. This led to the finding that reducing the nitrogen content to less than 0.07% is effective at suppressing nitride generation in an aging heat treatment, and preventing sulfide stress corrosion cracking and sulfide stress cracking in a temperature range of 80° C. or less.

The disclosed embodiments were completed on the basis of these findings, and the gist of the disclosed embodiments is as follows.

[1] A duplex stainless steel of a composition comprising, in mass %, C: 0.03% or less, Si: 1.0% or less, Mn: 0.10 to 1.5%, P: 0.030% or less, S: 0.005% or less, Cr: 20.0 to 30.0%, Ni: 5.0 to 10.0%, Mo: 2.0 to 5.0%, Cu: 2.0 to 6.0%, N: less than 0.07%, at least one selected from Al: 0.05 to 1.0%, Ti: 0.02 to 1.0%, and Nb: 0.02 to 1.0%, and the balance Fe and unavoidable impurities, the duplex stainless steel having a structure that is 20 to 70% austenite phase, and 30 to 80% ferrite phase in terms of a volume fraction, and a yield strength YS of 758 MPa or more.

[2] The duplex stainless steel according to item [1], wherein the composition further comprises one or more selected from the following groups A to E.

Group A:

W: 0.02 to 1.5% by mass

Group B:

V: 0.02 to 0.20% by mass

Group C:

At least one selected from Zr: 0.50% or less, and B: 0.0030% or less by mass

Group D:

At least one selected from REM: 0.005% or less, Ca: 0.005% or less, Sn: 0.20% or less, and Mg: 0.0002 to 0.01% by mass Group E:

At least one selected from Ta: 0.01 to 0.1%, Co: 0.01 to 1.0%, and Sb: 0.01 to 1.0% by mass

[3] A method for producing the duplex stainless steel having a yield strength YS of 758 MPa or more of item [1] or [2], the method comprising:

subjecting a stainless steel to a solution heat treatment in which the stainless steel is heated to a heating temperature of 1,000° C. or more, and cooled to a temperature of 300° C. or less at an average cooling rate of air cooling or faster; and subjecting the stainless steel to an aging heat treatment in which the stainless steel is heated to a temperature of 350 to 600° C., and cooled.

Advantageous Effects

The disclosed embodiments can provide a duplex stainless steel having high strength with a yield strength of 110 ksi or more (758 MPa or more), and excellent corrosion resistance, including excellent carbon dioxide corrosion resistance, excellent sulfide stress corrosion cracking resistance, and excellent sulfide stress cracking resistance, even in a hydrogen sulfide-containing severe corrosive environment. A duplex stainless steel produced according to the disclosed embodiments can be used to inexpensively produce a stainless steel seamless pipe for oil country tubular goods. This makes the disclosed embodiments highly advantageous in industry.

DETAILED DESCRIPTION

The disclosed embodiments are described below in detail.

The following first describes the composition of a duplex stainless steel of the disclosed embodiments, and the reasons for specifying the composition. In the following, "%" means percent by mass, unless otherwise specifically stated.

C: 0.03% or Less

Carbon is an element that has the effect to improve strength and low-temperature toughness by stabilizing the austenite phase. However, when the carbon content is more than 0.03%, the carbide precipitation by heat treatment becomes in excess, and the corrosion resistance of the steel reduces. For this reason, the upper limit of carbon content is 0.03%. The carbon content is preferably 0.02% or less, more preferably 0.01% or less. When contained in large amounts, carbon causes large precipitation of carbides during a heat treatment (described later), and it may not be possible to prevent excessive entry of diffusive hydrogen into steel. For this reason, the C content is preferably 0.0020% or more. More preferably, the C content is 0.0050% or more, further preferably 0.0065% or more.

Si: 1.0% or Less

Silicon is an element that is effective as a deoxidizing agent. Preferably, silicon is contained in an amount of 0.05% or more to obtain this effect. The Si content is more preferably 0.10% or more, further preferably 0.40% or more. However, with a Si content of more than 1.0%, the precipitation of intermetallic compounds by heat treatment becomes in excess, and the corrosion resistance of the steel reduces. For this reason, the Si content is 1.0% or less. The Si content is preferably 0.7% or less, more preferably 0.6% or less.

Mn: 0.10 to 1.5%

As is silicon, manganese is an effective deoxidizing agent. Manganese also improves hot workability by fixing the unavoidable steel component sulfur in the form of a sulfide. These effects are obtained with a Mn content of 0.10% or more. However, a Mn content in excess of 1.5% not only reduces hot workability, but adversely affects the corrosion resistance. For this reason, the Mn content is 0.10 to 1.5%. The Mn content is preferably 0.15% to 1.0%, more preferably 0.20% to 0.5%.

P: 0.030% or Less

In the disclosed embodiments, phosphorus should preferably be contained in as small an amount as possible because this element reduces corrosion resistance, including carbon dioxide corrosion resistance, pitting corrosion resistance, and sulfide stress cracking resistance. However, a P content of 0.030% or less is acceptable. For this reason, the P content is 0.030% or less. Preferably, the P content is 0.020% or less, more preferably 0.015% or less. Reducing the P content in excess increases the refining cost, and is economically disadvantageous. For this reason, the lower limit of P content is preferably 0.005% or more. The P content is more preferably 0.007% or more.

S: 0.005% or Less

Preferably, sulfur should be contained in as small an amount as possible because this element is highly detrimental to hot workability, and interferes with a stable operation of the pipe manufacturing process. However, normal pipe production is possible when the S content is 0.005% or less. For this reason, the S content is 0.005% or less. Preferably, the S content is 0.002% or less. More preferably, the S content is 0.0015% or less. High reduction of S content is industrially difficult, and involves high desulfurization cost in a steel making process, and poor productivity. For this reason, the lower limit of S content is preferably 0.0001%. More preferably, the S content is 0.0005% or more.

Cr: 20.0 to 30.0%

Chromium is a basic component that effectively maintains the corrosion resistance, and improves strength. Chromium needs to be contained in an amount of 20.0% or more to obtain these effects. However, a Cr content in excess of 30.0% facilitates precipitation of the a phase, and reduces both corrosion resistance and toughness. For this reason, the Cr content is 20.0 to 30.0%. For improved high strength, the Cr content is preferably 21.0% or more, more preferably 21.5% or more. From the viewpoint of sulfide stress cracking resistance and toughness, the Cr content is preferably 28.0% or less, more preferably 26.0% or less.

Ni: 5.0 to 10.0%

Nickel is an element that is added to stabilize the austenite phase, and produce a duplex structure. When the Ni content is less than 5.0%, the ferrite phase becomes predominant, and the duplex structure cannot be obtained. With a Ni content of more than 10.0%, the austenite phase becomes predominant, and the duplex structure cannot be obtained. Nickel is also an expensive element, and such a high Ni content is not favorable in terms of economy. For these reasons, the Ni content is 5.0 to 10.0%. Preferably, the Ni content is 6.0% or more. Preferably, the Ni content is 8.5% or less.

Mo: 2.0 to 5.0%

Molybdenum is an element that improves resistance against pitting corrosion caused by $Cl^-$ and low pH, and improves sulfide stress cracking resistance, and sulfide stress corrosion cracking resistance. In the disclosed embodiments, molybdenum needs to be contained in an amount of 2.0% or more. A high Mo content in excess of 5.0% causes precipitation of the σ phase, and reduces toughness and corrosion resistance. For this reason, the Mo content is 2.0 to 5.0%. Preferably, the Mo content is 2.5% to 4.5%. More preferably, the Mo content is 2.6% to 3.5%.

Cu: 2.0 to 6.0%

Copper precipitates in the form of fine ε-Cu in an aging heat treatment, and greatly improves strength. Copper also adds strength to the protective coating, and suppresses entry of hydrogen to the steel, and thereby improves sulfide stress cracking resistance, and sulfide stress corrosion cracking resistance. This makes the copper a very important element in the disclosed embodiments. Copper needs to be contained in an amount of 2.0% or more to obtain these effects. A Cu content in excess of 6.0% results in a low low-temperature toughness value. Such high Cu contents also causes excessive ε-Cu precipitation, and may reduce sulfide stress corrosion cracking resistance and sulfide stress cracking resistance. For this reason, the Cu content is 6.0% or less. Preferably, the Cu content is 2.5% to 5.5%. More preferably, the Cu content is 2.7% to 3.5%.

N: Less Than 0.07%

Nitrogen is known to improve pitting corrosion resistance, and contribute to solid solution strengthening in common duplex stainless steels. Nitrogen is actively added in an amount of 0.10% or more. However, the present inventors found that nitrogen actually forms various nitrides in an aging heat treatment, and causes reduction of sulfide stress corrosion cracking resistance and sulfide stress cracking resistance in a low temperature range of 80° C. or less, and that these adverse effects become more prominent when the N content is 0.07% or more. For these reasons, the N content is less than 0.07%. The N content is preferably 0.05% or less, more preferably 0.03% or less, further preferably 0.015% or less. In order to obtain the characteristics intended by the disclosed embodiments, the N content is preferably 0.001% or more. More preferably, the N content is 0.005% or more.

At Least One Selected from Al: 0.05 to 1.0%, Ti: 0.02 to 1.0%, and Nb: 0.02 to 1.0%

Al, Ti, and Nb are elements that generate intermetallic compounds with nickel in the aging heat treatment, and that greatly increase strength without lowering sulfide stress corrosion cracking resistance and sulfide stress cracking resistance in a low temperature range of 80° C. or less. This makes these elements very important in the disclosed embodiments. The effect cannot be obtained when Al is less than 0.05%, Ti is less than 0.02%, and Nb is less than 0.02%. When Al is more than 1.0%, Ti is more than 1.0%, and Nb is more than 1.0%, excess precipitation of intermetallic compounds occurs, and reduces sulfide stress corrosion cracking resistance and sulfide stress cracking resistance in a low temperature range of 80° C. or less. For this reason, the Al, Ti, and Nb contents are Al: 0.05 to 1.0%, Ti: 0.02 to 1.0%, and Nb: 0.02 to 1.0%. Preferably, the Al, Ti, and Nb contents are Al: 0.10% to 0.75%, Ti: 0.15% to 0.75%, and Nb: 0.15% to 0.75%. More preferably, the Al, Ti, and Nb contents are Al: 0.40% to 0.60%, Ti: 0.40% to 0.60%, and Nb: 0.40% to 0.60%. Al, Ti, and Nb may be added alone.

In the disclosed embodiments, the strength can further improve when two or more of Al, Ti, and Nb are added in combination. When two or more of Al, Ti, and Nb are added in combination, the contents of Al, Ti, and Nb are preferably 1.0% or less in total.

The balance is Fe and unavoidable impurities. Acceptable as unavoidable impurities is O (oxygen): 0.01% or less.

The foregoing components represent the basic components of the composition, and, with these basic components, the duplex stainless steel of the disclosed embodiments can have the desired characteristics. In addition to the foregoing basic components, the following selectable elements may be contained in the disclosed embodiments, as needed.

W: 0.02 to 1.5%

Tungsten is a useful element that improves sulfide stress corrosion cracking resistance, and sulfide stress cracking resistance. Preferably, tungsten is contained in an amount of 0.02% or more to obtain such effects. When contained in a large amount in excess of 1.5%, tungsten may reduce toughness. A high W content may also reduce sulfide stress cracking resistance. For this reason, tungsten, when contained, is contained in an amount of 0.02 to 1.5%. The W content is preferably 0.3 to 1.2%, more preferably 0.4 to 1.0%.

V: 0.02 to 0.20%

Vanadium is a useful element that improves steel strength through precipitation strengthening. Preferably, vanadium is contained in an amount of 0.02% or more to obtain such effects. When contained in excess of 0.20%, vanadium may reduce toughness. A high vanadium content may also reduce sulfide stress cracking resistance. For this reason, the V content is preferably 0.20% or less. Taken together, vanadium, when contained, is contained in an amount of 0.02 to 0.20%. Preferably, the V content is 0.03 to 0.08%, more preferably 0.04 to 0.07%.

At Least One Selected from Zr: 0.50% or Less, and B: 0.0030% or Less

Zirconium and boron are useful elements that contribute to improving strength, and may be contained by being selected, as needed.

In addition to contributing to improved strength, zirconium also contributes to improving sulfide stress corrosion cracking resistance. Preferably, zirconium is contained in an amount of 0.02% or more to obtain such effects. When contained in excess of 0.50%, zirconium may reduce toughness. A high Zr content may also reduce sulfide stress cracking resistance. For this reason, zirconium, when contained, is contained in an amount of 0.50% or less. The Zr content is preferably 0.05% to 0.40%, more preferably 0.10 to 0.30%.

Boron is a useful element that also contributes to improving hot workability, in addition to improving strength. Preferably, boron is contained in an amount of 0.0005% or more to obtain such effects. When contained in excess of 0.0030%, boron may reduce toughness, and hot workability. A high boron content may also reduce sulfide stress cracking resistance. For this reason, boron, when contained, is contained in an amount of 0.0030% or less. Preferably, the B content is 0.0008 to 0.0028%, more preferably 0.0010 to 0.0027%.

At Least One Selected from REM: 0.005% or Less, Ca: 0.005% or Less, Sn: 0.20% or Less, and Mg: 0.0002 to 0.01%

REM, Ca, Sn, and Mg are useful elements that contribute to improving sulfide stress corrosion cracking resistance, and may be contained by being selected, as needed. The preferred contents for providing such an effect are 0.001% or more for REM, 0.001% or more for Ca, 0.05% or more for Sn, and 0.0002% or more for Mg. More preferably, REM: 0.0015% or more, Ca: 0.0015% or more, Sn: 0.09% or more, and Mg: 0.0005% or more. It is not always economically advantageous to contain REM in excess of 0.005%, Ca in excess of 0.005%, Sn in excess of 0.20%, and Mg in excess of 0.01% because the effect is not necessarily proportional to the content, and may become saturated. For this reason, REM, Ca, Sn, and Mg, when contained, are contained in amounts of 0.005% or less, 0.005% or less, 0.20% or less, and 0.01% or less, respectively. More preferably, REM: 0.004% or less, Ca: 0.004% or less, Sn: 0.15% or less, and Mg: 0.005% or less.

At Least One Selected from Ta: 0.01 to 0.1%, Co: 0.01 to 1.0%, and Sb: 0.01 to 1.0%

Ta, Co, and Sb are useful elements that contribute to improving $CO_2$ corrosion resistance, sulfide stress cracking resistance, and sulfide stress corrosion cracking resistance, and may be contained by being selected, as needed. The preferred contents for providing such effects are 0.01% or more for Ta, 0.01% or more for Co, and 0.01% or more for Sb. The effect is not necessarily proportional to the content, and may become saturated when Ta, Co, and Sb are contained in excess of 0.1%, 1.0%, and 1.0%, respectively. For this reason, Ta, Co, and Sb, when contained, are contained in amounts of 0.01 to 0.1%, 0.01 to 1.0%, and 0.01 to 1.0%, respectively. In addition to the above effects, cobalt contributes to raising the Ms point, and also increasing strength. More preferably, Ta: 0.03 to 0.07%, Co: 0.03 to 0.3%, and Sb: 0.03 to 0.3%.

The following describes the structure of the duplex stainless steel of the disclosed embodiments, and the reasons for limiting the structure. In the following, "volume fraction" means a volume fraction relative to the whole steel sheet structure.

In addition to the foregoing composition, the duplex stainless steel of the disclosed embodiments has a composite structure that is 20 to 70% austenite phase, and 30 to 80% ferrite phase in terms of a volume fraction.

When the austenite phase is less than 20%, the desired sulfide stress cracking resistance and sulfide stress corrosion cracking resistance cannot be obtained. The desired high strength cannot be provided when the ferrite phase is less than 30%, and the austenite phase is more than 70%. For these reasons, the austenite phase is 20 to 70%. Preferably, the austenite phase is 30 to 60%. The ferrite phase is 30 to 80%, preferably 40 to 70%. The volume fractions of the austenite phase and the ferrite phase can be measured using the method described in the Example section below.

In the disclosed embodiments, the volume fractions of the austenite phase and the ferrite phase are controlled by a solution heat treatment (described later) so that the composite structure of 20 to 70% austenite phase, and 30 to 80% ferrite phase can be obtained.

The volume fraction of ferrite phase is determined by observing a surface perpendicular to the rolling direction of a stainless steel sheet, and that is located at the center in the thickness of the stainless steel sheet, using a scanning electron microscope. A test piece for structure observation is corroded with a Vilella's reagent, and the structure is imaged with a scanning electron microscope (1,000 times). The mean value of the area percentage of the ferrite phase is then calculated using an image analyzer to find the volume fraction (volume %).

The volume fraction of the austenite phase is measured by the X-ray diffraction method. A test piece to be measured is collected from a surface in the vicinity of the center in the thickness of the test piece material subjected to the heat treatment (solution heat treatment, and aging heat treatment), and the X-ray diffraction integral intensity is measured for the (220) plane of the austenite phase ($\gamma$), and the (211) plane of the ferrite phase ($\alpha$) by X-ray diffraction. The result of the volume fraction of the austenite phase is converted using the following formula.

$$\gamma(\text{Volume fraction})=100/(1+(I\alpha R\gamma/I\gamma R\alpha)),$$

wherein $I\alpha$ is the integral intensity of $\alpha$, $R\alpha$ is the crystallographic theoretical value for $\alpha$, $I\gamma$ is the integral intensity of $\gamma$, and $R\gamma$ is the crystallographic theoretical value for $\gamma$.

In addition to the austenite phase and the ferrite phase, the composition may contain precipitates, such as intermetallic compounds, carbides, nitrides, and sulfides, provided that the total content of these phases is 1% or less. Sulfide stress corrosion cracking resistance and sulfide stress cracking resistance greatly deteriorate when the total content of these precipitates exceeds 1%.

A method for producing the duplex stainless steel of the disclosed embodiments is described below.

In embodiments, a steel piece having the composition described above is used as a starting material. In the disclosed embodiments, the method used to produce the starting material is not particularly limited, and, typically, any known production method may be used.

The disclosed embodiments are applicable not only to seamless steel pipes, but to a range of other applications, including thin sheets, thick plates, UOE, ERW, spiral steel pipes, and butt-welded pipes. When the disclosed embodiments are applied to thin sheets, thick plates, UOE, ERW, spiral steel pipes, and butt-welded pipes, these may be typically produced using known producing methods. It is to be noted that the solution heat treatment is performed after hot rolling, regardless of the producing method.

The following describes a preferred producing method of the disclosed embodiments for seamless steel pipe applications.

In a preferred method, for example, a molten steel of the foregoing composition is made into steel using an ordinary steel making process such as by using a converter, and formed into a steel pipe material (staring material), for example, a billet, using an ordinary method such as continuous casting, and ingot casting-breakdown rolling. The steel pipe material is then heated, and formed into a seamless steel pipe of the foregoing composition and of the desired dimensions, typically by using a known pipe manufacturing process, for example, such as extrusion by the Eugene Sejerne method, and hot rolling by the Mannesmann method.

After production, the seamless steel pipe is preferably cooled to room temperature at an average cooling rate of air cooling or faster. The seamless steel pipe may be quenched and tempered, as required.

In the disclosed embodiments, the cooled seamless steel pipe is subjected to a solution heat treatment, in which the steel pipe is heated to a heating temperature of 1,000° C. or more, and cooled to a temperature of 300° C. or less at an average cooling rate of air cooling or faster, preferably 1° C./s or more. In this way, intermetallic compounds, carbides, nitrides, sulfides, and other such compounds that had previously precipitated can be dissolved, and a seamless steel pipe of a structure containing the appropriate amounts of austenite phase and ferrite phase can be produced.

The desired high toughness cannot be provided when the heating temperature of the solution heat treatment is less than 1,000° C. The heating temperature of the solution heat treatment is preferably 1,150° C. or less from the viewpoint of preventing coarsening of the structure. More preferably, the heating temperature of the solution heat treatment is 1,020° C. or more. More preferably, the heating temperature of the solution heat treatment is 1,130° C. or less. In the disclosed embodiments, the heating temperature of the solution heat treatment is maintained for at least 5 min from the standpoint of making a uniform temperature in the material. Preferably, the heating temperature of the solution heat treatment is maintained for at most 210 min. When the heating temperature of the solution heat treatment is less than 1,000° C., intermetallic compounds, carbides, nitrides, sulfides, and other such compounds that had previously precipitated cannot be dissolved, and YS and TS increase.

When the average cooling rate of the solution heat treatment is less than 1° C./s, intermetallic compounds, such as the $\sigma$ phase and the $\chi$ phase precipitate during the cooling process, and the corrosion resistance may seriously reduce. For this reason, the average cooling rate of the solution heat treatment is preferably 1° C./s or more. The upper limit of average cooling rate is not particularly limited. As used herein, "average cooling rate" means the average of cooling rates from the heating temperature to the cooling stop temperature of the solution heat treatment.

When the cooling stop temperature of the solution heat treatment is higher than 300° C., the α-prime phase subsequently precipitates, and the corrosion resistance seriously reduces. For this reason, the cooling stop temperature of the solution heat treatment is 300° C. or less. Preferably, the cooling stop temperature of the solution heat treatment is 200° C. or less.

After the solution heat treatment, the seamless steel pipe is subjected to an aging heat treatment, in which the steel pipe is heated to a temperature of 350 to 600° C., and cooled. By the aging heat treatment, the added copper precipitates in the form of ε-Cu, and the added Al, Ti, and Nb form intermetallic compounds with nickel, and contribute to strength. This completes the high-strength duplex stainless steel seamless pipe having the desired high strength, and excellent corrosion resistance.

When the heating temperature of the aging heat treatment is higher than 600° C., the intermetallic compounds coarsen, and the desired high strength and excellent corrosion resistance cannot be obtained. When the heating temperature of the aging heat treatment is less than 350° C., the intermetallic compounds cannot sufficiently precipitate, and the desired high strength cannot be obtained. For these reasons, the heating temperature of the aging heat treatment is preferably 350 to 600° C. More preferably, the heating temperature of the aging heat treatment is 400° C. to 550° C. In the disclosed embodiments, the heating of the aging heat treatment is maintained for at least 5 min from the standpoint of making a uniform temperature in the material. The desired uniform structure cannot be obtained when the heating of the aging heat treatment is maintained for less than 5 min. More preferably, the heating of the aging heat treatment is maintained for at least 20 min. Preferably, the heating of the aging heat treatment is maintained for at most 210 min. More preferably, the heating of the aging heat treatment is maintained for at most 100 min. As used herein, "cooling in the aging heat treatment" means cooling from a temperature range of 350 to 600° C. to room temperature at an average cooling rate of air cooling or faster. Preferably, the average cooling rate of the cooling in the aging heat treatment is 1° C./s or more.

EXAMPLES

The disclosed embodiments are further described below through Examples. It is to be noted that the disclosed embodiments are not limited by the following Examples.

In the following Examples, molten steels of the compositions shown in Table 1 were made into steel with a converter, and cast into billets (steel pipe material) by continuous casting. The steel pipe material was then heated at 1,150 to 1,250° C., and hot worked with a heating model seamless rolling machine to produce a seamless steel pipe measuring 83.8 mm in outer diameter and 12.7 mm in wall thickness. After production, the seamless steel pipe was air cooled.

The seamless steel pipe was then subjected to a solution heat treatment, in which the seamless steel pipe was heated and cooled under the conditions shown in Table 2. This was followed by an aging heat treatment, in which the seamless steel pipe was heated and air cooled under the conditions shown in Table 2.

From the seamless steel pipe finally obtained after the heat treatment, a test piece for structure observation was collected, and the constituent structure was quantitatively evaluated. The test piece was also examined by a tensile test, a corrosion test, a sulfide stress corrosion cracking resistance test (SCC resistance test), and a sulfide stress cracking resistance test (SSC resistance test). The tests were conducted in the manner described below.

(1) Volume Fractions (Volume %) of Phases in the Whole Steel Sheet Structure

The volume fraction of the ferrite phase was determined by scanning electron microscopy of a surface perpendicular to the rolling direction of the steel pipe, and that was located at the center in the thickness of the steel pipe. The test piece for structure observation was corroded with a Vilella's reagent, and the structure was imaged with a scanning electron microscope (1,000 times). The mean value of the area percentage of the ferrite phase was then calculated using an image analyzer to find the volume fraction (volume %).

The volume fraction of the austenite phase was measured by the X-ray diffraction method. A test piece to be measured was collected from a surface in the vicinity of the center in the thickness of the test piece material subjected to the heat treatment (solution heat treatment, and aging heat treatment), and the X-ray diffraction integral intensity was measured for the (220) plane of the austenite phase (γ), and the (211) plane of the ferrite phase (α) by X-ray diffraction. The result of the volume fraction of the austenite phase was converted using the following formula.

$$\gamma(\text{Volume fraction})=100/(1+(I\alpha R\gamma/I\gamma R\alpha)),$$

wherein Iα is the integral intensity of α, Rα is the crystallographic theoretical value for α, Iγ is the integral intensity of γ, and Rγ is the crystallographic theoretical value for γ.

(2) Tensile Characteristics

A strip specimen specified by API standard was collected from the heat-treated test piece material in such an orientation that the tensile direction was in the axial direction of the pipe, and subjected to a tensile test according to the API-5CT specifications to determine its tensile characteristics (yield strength YS, tensile strength TS). In the disclosed embodiments, the test piece was evaluated as being acceptable when it had a yield strength of 758 MPa or more.

(3) Corrosion Test (Carbon Dioxide Corrosion Resistance Test)

A corrosion test piece, measuring 3 mm in thickness, 30 mm in width, and 40 mm in length, was machined from the heat-treated test piece material, and subjected to a corrosion test.

The corrosion test was conducted by dipping the test piece for 336 hours in a test solution (a 20 mass % NaCl aqueous solution; liquid temperature: 200° C., a 30-atm $CO_2$ gas atmosphere) charged into an autoclave. After the test, the weight of the test piece was measured, and the corrosion rate was determined from the calculated weight reduction before and after the corrosion test. In the disclosed embodiments, the test piece was evaluated as being acceptable when it had a corrosion rate of 0.125 mm/y or less.

(4) Sulfide Stress Cracking Resistance Test (SSC Resistance Test)

A round rod-shaped test piece (diameter ϕ=6.4 mm) was machined from the heat-treated test piece material according to NACE TM0177, Method A, and subjected to an SSC resistance test.

In the SSC resistance test, the test piece was dipped in an aqueous test solution (a 20 mass % NaCl aqueous solution; liquid temperature: 25° C.; atmosphere of $H_2S$: 0.03 MPa, and $CO_2$: 0.07 MPa) having an adjusted pH of 3.5 with addition of acetic acid and sodium acetate. The test piece was kept in the solution for 720 hours to apply a stress equal to 90% of the yield stress. After the test, the test piece was observed for the presence or absence of cracking. In the disclosed embodiments, the test piece was evaluated as being acceptable when it did not have a crack after the test. In Table 3, the open circle represents no cracking, and the cross represents cracking.

(5) Sulfide Stress Corrosion Cracking Resistance Test (SCC Resistance Test)

A 4-point bend test piece, measuring 3 mm in thickness, 15 mm in width, and 115 mm in length, was collected by machining the heat-treated test piece material, and subjected to an SCC resistance test.

In the SCC resistance test, the test piece was dipped in an aqueous test solution (a 10 mass % NaCl aqueous solution; liquid temperature: 80° C.; $H_2S$: 35 kPa; $CO_2$: 2 MPa) charged into an autoclave. The test piece was kept in the solution for 720 hours to apply a stress equal to 100% of the yield stress. After the test, the test piece was observed for the presence or absence of cracking. In the disclosed embodiments, the test piece was evaluated as being acceptable when it did not have a crack after the test. In Table 3, the open circle represents no cracking, and the cross represents cracking.

The results of these tests are presented in Table 3.

TABLE 1

| Steel | Composition (mass %) | | | | | | | | | | | | |
|---|---|---|---|---|---|---|---|---|---|---|---|---|---|
| No. | C | Si | Mn | P | S | Al | Cr | Cu | Ni | Mo | Nb | Ti | N |
| A | 0.0068 | 0.570 | 0.34 | 0.011 | 0.0014 | 0.458 | 22.20 | 3.00 | 7.20 | 3.30 | — | — | 0.007 |
| B | 0.0083 | 0.520 | 0.35 | 0.013 | 0.0009 | 0.504 | 22.20 | 3.00 | 8.50 | 2.90 | — | — | 0.008 |
| C | 0.0070 | 0.490 | 0.28 | 0.014 | 0.0006 | — | 21.60 | 2.70 | 7.20 | 3.10 | — | 0.500 | 0.008 |
| D | 0.0085 | 0.520 | 0.28 | 0.015 | 0.0010 | — | 21.50 | 2.70 | 7.50 | 3.20 | — | 0.500 | 0.006 |
| E | 0.0106 | 0.500 | 0.37 | 0.014 | 0.0011 | — | 21.80 | 3.00 | 6.60 | 3.10 | 0.508 | — | 0.009 |
| F | 0.0082 | 0.550 | 0.35 | 0.012 | 0.0007 | — | 21.20 | 3.00 | 7.50 | 3.30 | 0.490 | — | 0.007 |
| G | 0.0713 | 0.410 | 1.05 | 0.015 | 0.0010 | 0.006 | 24.70 | 1.10 | 5.40 | 1.50 | — | — | 0.070 |
| H | 0.0092 | 0.540 | 0.32 | 0.009 | 0.0012 | 0.529 | 21.30 | 2.90 | 6.80 | 3.30 | — | — | 0.007 |
| I | 0.0102 | 0.530 | 0.30 | 0.009 | 0.0013 | 0.498 | 21.10 | 3.00 | 6.80 | 2.90 | — | — | 0.008 |
| J | 0.0086 | 0.510 | 0.31 | 0.011 | 0.0013 | 0.513 | 21.00 | 2.90 | 6.00 | 3.10 | — | — | 0.007 |
| K | 0.0092 | 0.540 | 0.30 | 0.010 | 0.0012 | 0.518 | 21.80 | 2.80 | 6.90 | 3.20 | — | — | 0.006 |
| L | 0.0064 | 0.594 | 0.36 | 0.010 | 0.0013 | 0.418 | 22.27 | 3.10 | 7.74 | 3.54 | — | — | 0.008 |
| M | 0.0116 | 0.474 | 0.38 | 0.014 | 0.0010 | — | 21.08 | 2.99 | 6.66 | 2.86 | 0.497 | — | 0.008 |
| N | 0.0078 | 0.487 | 0.31 | 0.014 | 0.0006 | — | 22.27 | 2.93 | 6.89 | 3.11 | — | 0.492 | 0.006 |
| O | 0.0076 | 0.524 | 0.37 | 0.012 | 0.0006 | 0.250 | 21.37 | 2.95 | 6.47 | 3.13 | 0.243 | — | 0.006 |
| P | 0.0089 | 0.478 | 0.30 | 0.012 | 0.0009 | 0.239 | 21.64 | 3.24 | 7.03 | 3.04 | — | 0.228 | 0.006 |
| Q | 0.0101 | 0.532 | 0.33 | 0.012 | 0.0011 | 0.144 | 21.36 | 2.78 | 7.16 | 2.93 | 0.162 | 0.180 | 0.006 |
| R | 0.0089 | 0.565 | 0.31 | 0.009 | 0.0012 | 0.479 | 21.23 | 3.02 | 6.13 | 2.68 | — | — | 0.009 |
| S | 0.0078 | 0.553 | 0.35 | 0.012 | 0.0012 | — | 22.03 | 3.24 | 6.33 | 2.82 | 0.546 | — | 0.008 |
| T | 0.0091 | 0.449 | 0.27 | 0.014 | 0.0005 | — | 22.18 | 2.89 | 6.89 | 2.98 | — | 0.452 | 0.006 |
| U | 0.0066 | 0.569 | 0.34 | 0.013 | 0.0009 | 0.234 | 22.50 | 3.05 | 7.14 | 2.92 | — | 0.261 | 0.008 |
| V | 0.0077 | 0.579 | 0.32 | 0.011 | 0.0013 | 0.248 | 21.54 | 2.99 | 6.62 | 2.96 | 0.259 | — | 0.007 |
| W | 0.0087 | 0.478 | 0.34 | 0.011 | 0.0012 | 0.495 | 21.01 | 2.72 | 6.57 | 3.04 | — | — | 0.006 |
| X | 0.0072 | 0.512 | 0.29 | 0.014 | 0.0009 | 0.218 | 22.51 | 2.76 | 6.33 | 3.39 | — | 0.253 | 0.006 |
| Y | 0.0098 | 0.501 | 0.34 | 0.011 | 0.0012 | 0.219 | 21.65 | 2.74 | 6.30 | 2.83 | 0.270 | — | 0.007 |
| Z | 0.0075 | 0.545 | 0.32 | 0.009 | 0.0012 | 0.489 | 21.15 | 2.94 | 6.22 | 3.27 | — | — | 0.006 |
| AA | 0.0069 | 0.540 | 0.29 | 0.010 | 0.0012 | 0.492 | 22.00 | 1.73 | 6.20 | 2.80 | — | — | 0.007 |
| AB | 0.0071 | 0.510 | 0.35 | 0.010 | 0.0013 | 1.152 | 21.80 | 2.92 | 6.80 | 2.90 | — | 0.512 | 0.006 |
| AC | 0.0070 | 0.510 | 0.28 | 0.014 | 0.0008 | — | 22.00 | 2.80 | 7.00 | 3.30 | — | 1.197 | 0.007 |
| AD | 0.0095 | 0.480 | 0.34 | 0.013 | 0.0011 | 0.469 | 21.40 | 2.83 | 7.20 | 3.00 | 1.111 | — | 0.009 |
| AE | 0.0113 | 0.490 | 0.36 | 0.013 | 0.0007 | 0.517 | 21.30 | 3.11 | 7.30 | 2.70 | — | — | 0.091 |

| Steel | Composition (mass %) | | | | | | | | | | |
|---|---|---|---|---|---|---|---|---|---|---|---|
| No. | W | V | B | Zr | REM | Ca | Sn | Mg | Ta | Co | Sb |
| A | — | 0.048 | — | — | — | — | — | — | — | — | — |
| B | — | 0.064 | — | — | — | — | — | — | — | — | — |
| C | — | 0.060 | — | — | — | — | — | — | — | — | — |
| D | — | 0.068 | — | — | — | — | — | — | — | — | — |
| E | — | 0.047 | — | — | — | — | — | — | — | — | — |
| F | — | 0.055 | — | — | — | — | — | — | — | — | — |
| G | — | — | — | — | — | — | — | — | — | — | — |
| H | — | 0.048 | — | — | — | — | — | — | — | — | — |
| I | 0.50 | 0.061 | — | — | — | — | — | — | — | — | — |
| J | — | 0.064 | 0.0033 | 0.11 | — | — | — | — | — | — | — |
| K | — | 0.064 | — | — | 0.0022 | 0.0025 | 0.10 | 0.0012 | 0.057 | 0.053 | 0.053 |
| L | — | — | — | — | — | — | — | — | — | — | — |
| M | — | — | — | — | — | — | — | — | — | — | — |
| N | — | — | — | — | — | — | — | — | — | — | — |
| O | — | — | — | — | — | — | — | — | — | — | — |
| P | — | — | — | — | — | — | — | — | — | — | — |
| Q | — | — | — | — | — | — | — | — | — | — | — |
| R | 0.51 | — | — | — | — | — | — | — | — | — | — |
| S | — | 0.062 | — | — | — | — | — | — | — | — | — |
| T | — | 0.051 | — | — | — | — | — | — | — | — | — |
| U | — | 0.042 | — | — | — | — | — | — | — | — | — |
| V | — | 0.049 | — | — | — | — | — | — | — | — | — |
| W | — | 0.063 | 0.0027 | 0.12 | — | — | — | — | — | — | — |
| X | — | 0.055 | 0.0019 | 0.11 | — | — | — | — | — | — | — |

TABLE 1-continued

| | | | | | | | | | | | |
|---|---|---|---|---|---|---|---|---|---|---|---|
| Y | — | 0.041 | 0.0019 | 0.11 | — | — | — | — | — | — | — |
| Z | — | 0.055 | — | — | 0.0020 | 0.0025 | 0.09 | 0.0011 | — | — | — |
| AA | — | 0.048 | — | — | — | — | — | — | — | — | — |
| AB | — | 0.063 | — | — | — | — | — | — | — | — | — |
| AC | — | 0.058 | — | — | — | — | — | — | — | — | — |
| AD | — | 0.053 | — | — | — | — | — | — | — | — | — |
| AE | — | 0.046 | — | — | — | — | — | — | — | — | — |

* Underline means outside the range of the disclosed embodiments.

TABLE 2

| | | Solution heat treatment | | | | Aging heat treatment | |
|---|---|---|---|---|---|---|---|
| Steel pipe No. | Steel No. | Heating temperature (° C.) | Holding time (min) | Average cooling rate (° C./s) | Cooling stop temperature (° C.) | Heating temperature (° C.) | Holding time (min) |
| 1 | A | 1070 | 20 | 25 | 25 | 500 | 60 |
| 2 | A | 1070 | 20 | 25 | 25 | 550 | 60 |
| 3 | B | 1070 | 20 | 25 | 25 | 450 | 60 |
| 4 | B | 1070 | 20 | 25 | 25 | 500 | 60 |
| 5 | C | 1070 | 20 | 25 | 25 | 500 | 60 |
| 6 | C | 1070 | 20 | 25 | 25 | 550 | 60 |
| 7 | D | 1070 | 20 | 25 | 25 | 500 | 60 |
| 8 | D | 950 | 30 | 25 | 25 | 500 | 60 |
| 9 | E | 1070 | 20 | 25 | 25 | 500 | 60 |
| 10 | F | 1070 | 20 | 25 | 25 | 500 | 60 |
| 11 | G | 1070 | 20 | 25 | 25 | 550 | 60 |
| 12 | H | 1070 | 20 | 25 | 25 | 550 | 60 |
| 13 | I | 1070 | 20 | 25 | 25 | 550 | 60 |
| 14 | J | 1070 | 20 | 25 | 25 | 550 | 60 |
| 15 | K | 1070 | 20 | 25 | 25 | 550 | 60 |
| 16 | L | 1070 | 20 | 22 | 25 | 500 | 60 |
| 17 | M | 1040 | 20 | 28 | 26 | 460 | 60 |
| 18 | N | 1050 | 20 | 28 | 25 | 530 | 60 |
| 19 | O | 1030 | 20 | 27 | 22 | 535 | 60 |
| 20 | P | 1060 | 20 | 24 | 30 | 480 | 60 |

TABLE 2-continued

| | | Solution heat treatment | | | | Aging heat treatment | |
|---|---|---|---|---|---|---|---|
| Steel pipe No. | Steel No. | Heating temperature (° C.) | Holding time (min) | Average cooling rate (° C./s) | Cooling stop temperature (° C.) | Heating temperature (° C.) | Holding time (min) |
| 21 | Q | 1040 | 20 | 26 | 24 | 480 | 60 |
| 22 | R | 1100 | 20 | 30 | 22 | 570 | 60 |
| 23 | S | 1120 | 20 | 25 | 22 | 550 | 60 |
| 24 | T | 1120 | 20 | 29 | 27 | 530 | 60 |
| 25 | U | 1040 | 20 | 26 | 29 | 465 | 60 |
| 26 | V | 1030 | 20 | 26 | 23 | 475 | 60 |
| 27 | W | 1040 | 20 | 29 | 22 | 570 | 60 |
| 28 | X | 1100 | 20 | 30 | 23 | 490 | 60 |
| 29 | Y | 1110 | 20 | 22 | 21 | 480 | 60 |
| 30 | Z | 1120 | 20 | 29 | 27 | 600 | 60 |
| 31 | A | 1070 | 20 | 25 | 25 | 300 | 60 |
| 32 | A | 1070 | 20 | 25 | 25 | 650 | 60 |
| 33 | AA | 1070 | 20 | 25 | 25 | 550 | 60 |
| 34 | AB | 1070 | 20 | 25 | 25 | 400 | 60 |
| 35 | AC | 1070 | 20 | 25 | 25 | 400 | 60 |
| 36 | AD | 1070 | 20 | 25 | 25 | 500 | 60 |
| 37 | AE | 1070 | 20 | 25 | 25 | 500 | 60 |
| 38 | S | 1220 | 20 | 25 | 22 | 550 | 60 |

* Underline means outside the range of the disclosed embodiments.

TABLE 3

| | | Volume fraction | | Tensile characteristics | | Corrosion | SSC resistance | SCC resistance | |
|---|---|---|---|---|---|---|---|---|---|
| Steel pipe No. | Steel No. | Volume fraction of ferrite phase (%) | Volume fraction of austenite phase (%) | Yield strength YS (MPa) | Tensile strength TS (MPa) | test Corrosion rate (mm/y) | test Presence or absence of cracking | test Presence or absence of cracking | Remarks Present Example/ Comparative Example |
| 1 | A | 68 | 32 | 884 | 1016 | 0.010 | ○ | ○ | Present Example |
| 2 | A | 64 | 36 | 792 | 943 | 0.010 | ○ | ○ | Present Example |
| 3 | B | 60 | 40 | 819 | 987 | 0.010 | ○ | ○ | Present Example |
| 4 | B | 57 | 43 | 776 | 982 | 0.010 | ○ | ○ | Present Example |
| 5 | C | 68 | 32 | 918 | 1080 | 0.010 | ○ | ○ | Present Example |
| 6 | C | 73 | 27 | 863 | 1027 | 0.010 | ○ | ○ | Present Example |
| 7 | D | 57 | 43 | 824 | 969 | 0.010 | ○ | ○ | Present Example |
| 8 | D | 63 | 37 | 976 | 1162 | 0.010 | ○ | ○ | Present Example |
| 9 | E | 69 | 31 | 777 | 959 | 0.010 | ○ | ○ | Present Example |
| 10 | F | 56 | 44 | 763 | 942 | 0.010 | ○ | ○ | Present Example |
| 11 | G | 57 | 43 | 660 | 767 | 0.010 | x | x | Comparative Example |
| 12 | H | 67 | 33 | 780 | 940 | 0.010 | ○ | ○ | Present Example |
| 13 | I | 66 | 34 | 771 | 886 | 0.010 | ○ | ○ | Present Example |
| 14 | J | 65 | 35 | 761 | 885 | 0.010 | x | ○ | Comparative Example |
| 15 | K | 63 | 37 | 774 | 900 | 0.010 | ○ | ○ | Present Example |
| 16 | L | 65 | 35 | 900 | 1071 | 0.010 | ○ | ○ | Present Example |
| 17 | M | 71 | 29 | 790 | 952 | 0.010 | ○ | ○ | Present Example |
| 18 | N | 66 | 34 | 899 | 1045 | 0.010 | ○ | ○ | Present Example |
| 19 | O | 71 | 29 | 844 | 993 | 0.010 | ○ | ○ | Present Example |
| 20 | P | 67 | 33 | 904 | 1089 | 0.010 | ○ | ○ | Present Example |
| 21 | Q | 66 | 34 | 877 | 1020 | 0.010 | ○ | ○ | Present Example |
| 22 | R | 68 | 32 | 759 | 893 | 0.010 | ○ | ○ | Present Example |
| 23 | S | 72 | 28 | 793 | 955 | 0.010 | ○ | ○ | Present Example |
| 24 | T | 68 | 32 | 915 | 1064 | 0.010 | ○ | ○ | Present Example |
| 25 | U | 68 | 32 | 882 | 1050 | 0.010 | ○ | ○ | Present Example |
| 26 | V | 67 | 33 | 838 | 974 | 0.010 | ○ | ○ | Present Example |

TABLE 3-continued

| Steel pipe No. | Steel No. | Volume fraction: Volume fraction of ferrite phase (%) | Volume fraction: Volume fraction of austenite phase (%) | Tensile characteristics: Yield strength YS (MPa) | Tensile characteristics: Tensile strength TS (MPa) | Corrosion test: Corrosion rate (mm/y) | SSC resistance test: Presence or absence of cracking | SCC resistance test: Presence or absence of cracking | Remarks Present Example/ Comparative Example |
|---|---|---|---|---|---|---|---|---|---|
| 27 | W | 65 | 35 | 775 | 934 | 0.010 | ○ | ○ | Present Example |
| 28 | X | 69 | 31 | 900 | 1084 | 0.083 | ○ | ○ | Present Example |
| 29 | Y | 67 | 33 | 837 | 996 | 0.010 | ○ | ○ | Present Example |
| 30 | Z | 61 | 39 | 792 | 943 | 0.010 | ○ | ○ | Present Example |
| 31 | A | 65 | 35 | 666 | 810 | 0.010 | ○ | ○ | Comparative Example |
| 32 | A | 67 | 33 | 678 | 808 | 0.010 | x | x | Comparative Example |
| 33 | AA | 64 | 36 | 736 | 901 | 0.010 | x | x | Comparative Example |
| 34 | AB | 66 | 34 | 923 | 1024 | 0.010 | x | x | Comparative Example |
| 35 | AC | 70 | 30 | 895 | 1001 | 0.010 | x | x | Comparative Example |
| 36 | AD | 75 | 25 | 959 | 1173 | 0.010 | x | x | Comparative Example |
| 37 | AE | 59 | 41 | 791 | 1015 | 0.010 | x | x | Comparative Example |
| 38 | S | 89 | 11 | 812 | 955 | 0.010 | x | x | Comparative Example |

* Underline means outside the range of the disclosed embodiments.
*○: No cracking
x: Cracking The present examples all had high strength with a yield strength of 758 MPa or more. The high-strength duplex stainless steels of the present examples also had excellent corrosion resistance (carbon dioxide corrosion resistance) in a high-temperature, $CO_2$— and $Cl^-$-containing corrosive environment of 200° C. and higher. The high-strength duplex stainless steels of the present examples produced no cracks (SSC, SCC) in the $H_2S$-containing environment, and had excellent sulfide stress cracking resistance, and excellent sulfide stress corrosion cracking resistance. On the other hand, the comparative examples outside of the range of the disclosed embodiments did not have at least one selected from the desired high strength (yield strength of 758 MPa or more), the desired carbon dioxide corrosion resistance, the desired sulfide stress cracking resistance (SSC resistance) and the desired sulfide stress corrosion cracking resistance (SCC resistance) of the disclosed embodiments.

The invention claimed is:

1. A duplex stainless steel having a chemical composition comprising, by mass %:

C: 0.03% or less,
Si: 1.0% or less,
Mn: 0.10 to 1.5%,
P: 0.030% or less,
S: 0.005% or less,
Cr: 20.0 to 30.0%,
Ni: 5.0 to 10.0%,
Mo: 2.0 to 5.0%,
Cu: 3.02 to 6.0%,
N: less than 0.07%,
at least one selected from the group consisting of Al: 0.05 to 1.0%, Ti: 0.02 to 1.0%, and Nb: 0.02 to 1.0%, and
the balance being Fe and unavoidable impurities,
wherein the duplex stainless steel has a structure that is in a range of 20 to 70% austenite phase, by volume fraction, and in a range of 30 to 80% ferrite phase, by volume fraction, and a yield strength YS of 758 MPa or more.

2. The duplex stainless steel according to claim 1, wherein the chemical composition further comprises at least one group selected from the groups consisting of:

Group A: W: 0.02 to 1.5%, by mass %,
Group B: V: 0.02 to 0.20%, by mass %,
Group C: at least one selected from the group consisting of Zr: 0.50% or less, and B: 0.0030% or less, by mass %,
Group D: at least one selected from the group consisting of rare earth metals: 0.005% or less, Ca: 0.005% or less, Sn: 0.20% or less, and Mg: 0.0002 to 0.01%, by mass %, and
Group E: at least one selected from the group consisting of Ta: 0.01 to 0.1%, Co: 0.01 to 1.0%, and Sb: 0.01 to 1.0%, by mass %.

3. A method for producing the duplex stainless steel of claim 1, the method comprising:

subjecting a stainless steel to a solution heat treatment in which the stainless steel is heated to a heating temperature of 1,000° C. or more, and cooled to a temperature of 300° C. or less at an average cooling rate of air cooling or faster; and
subjecting the stainless steel to an aging heat treatment in which the stainless steel is heated to a temperature in a range of 350 to 600° C., and cooled.

4. A method for producing the duplex stainless steel of claim 2, the method comprising:

subjecting a stainless steel to a solution heat treatment in which the stainless steel is heated to a heating temperature of 1,000° C. or more, and cooled to a temperature of 300° C. or less at an average cooling rate of air cooling or faster; and
subjecting the stainless steel to an aging heat treatment in which the stainless steel is heated to a temperature in a range of 350 to 600° C., and cooled.

5. The duplex stainless steel according to claim 1, wherein the chemical composition comprises at least one selected from the group consisting of Al: 0.218 to 1.0%, and Ti: 0.180 to 1.0%, by mass %.

6. The duplex stainless steel according to claim 1, wherein the chemical composition comprises at least two selected from the group consisting of Al: 0.218 to 1.0%, and Ti: 0.180 to 1.0%, and Nb: 0.02 to 1.0%.

* * * * *